US009004159B2

(12) United States Patent
Alsup et al.

(10) Patent No.: US 9,004,159 B2
(45) Date of Patent: Apr. 14, 2015

(54) HIGH PERFORMANCE WELLBORE DEPARTURE AND DRILLING SYSTEM

(75) Inventors: Shelton W. Alsup, Houston, TX (US); Philip M. Gregurek, Pearland, TX (US); Shantanu N. Swadi, Cypress, TX (US)

(73) Assignee: Smith International, Inc., Houston, TX (US)

( * ) Notice: Subject to any disclaimer, the term of this patent is extended or adjusted under 35 U.S.C. 154(b) by 387 days.

(21) Appl. No.: 13/410,134

(22) Filed: Mar. 1, 2012

(65) Prior Publication Data

US 2012/0222902 A1 Sep. 6, 2012

Related U.S. Application Data

(60) Provisional application No. 61/448,085, filed on Mar. 1, 2011.

(51) Int. Cl.

| | |
|---|---|
| ***E21B 7/06*** | (2006.01) |
| ***E21B 7/08*** | (2006.01) |
| ***E21B 29/06*** | (2006.01) |
| ***E21B 10/43*** | (2006.01) |

(52) U.S. Cl.
CPC ..... *E21B 10/43* (2013.01); *E21B 29/06* (2013.01); *E21B 7/061* (2013.01)

(58) Field of Classification Search
CPC ..... E21B 7/06; E21B 7/061; E21B 7/064
USPC ..... 175/61; 166/255.3, 117.5, 117.6
See application file for complete search history.

(56) References Cited

U.S. PATENT DOCUMENTS

| | | | |
|---|---|---|---|
| 2,498,159 | A | 2/1944 | Gammill |
| 2,553,874 | A | 5/1951 | Spaulding et al. |
| 4,397,355 | A | 8/1983 | McLamore |
| 4,765,404 | A | 8/1988 | Bailey et al. |
| 5,361,833 | A | 11/1994 | Schock et al. |
| 5,771,972 | A | 6/1998 | Dewey et al. |
| 5,806,596 | A | 9/1998 | Hardy et al. |
| 5,826,651 | A | 10/1998 | Lee et al. |
| 5,878,818 | A | 3/1999 | Hebert et al. |
| 5,887,655 | A | 3/1999 | Haugen et al. |
| 5,887,668 | A | 3/1999 | Haugen et al. |
| 5,894,889 | A | 4/1999 | Dewey et al. |
| 6,032,740 | A | 3/2000 | Schnitker et al. |
| 6,050,334 | A | 4/2000 | McGarian et al. |
| 6,089,319 | A | 7/2000 | Singleton |

(Continued)

FOREIGN PATENT DOCUMENTS

WO 2006070204 7/2006

OTHER PUBLICATIONS

International Search Report and Written Opinion of PCT Application No. PCT/US2012/027322 dated Sep. 25, 2012: pp. 1-18.

(Continued)

*Primary Examiner* — Brad Harcourt

(57) ABSTRACT

A system and method facilitate drilling of lateral wellbores by optionally eliminating one or more trips downhole. The system and method provide for drilling a lateral wellbore by enabling the milling of a casing window and the drilling of the desired lateral wellbore to a target depth during a single trip down hole. The system and method also facilitate better downhole dynamics control and improved overall bottom hole assembly functionality during drilling.

20 Claims, 8 Drawing Sheets

(56) References Cited

U.S. PATENT DOCUMENTS

| | | | | |
|---|---|---|---|---|
| 6,102,123 | A | 8/2000 | Bailey et al. | |
| 6,464,002 | B1 | 10/2002 | Hart et al. | |
| 6,581,699 | B1 | 6/2003 | Chen et al. | |
| 6,612,383 | B2 | 9/2003 | Desai et al. | |
| 6,719,045 | B2 | 4/2004 | Hart et al. | |
| 7,020,597 | B2 * | 3/2006 | Oliver et al. | 703/7 |
| 7,178,589 | B2 | 2/2007 | Campbell et al. | |
| 7,207,401 | B2 | 4/2007 | Dewey et al. | |
| 7,225,889 | B2 | 6/2007 | Dewey | |
| 7,267,175 | B2 | 9/2007 | Haugen et al. | |
| 7,610,971 | B2 | 11/2009 | Neff | |
| 2001/0035302 | A1 | 11/2001 | Desai et al. | |
| 2002/0195243 | A1 | 12/2002 | Hart et al. | |
| 2004/0089443 | A1 | 5/2004 | Dewey et al. | |
| 2004/0173384 | A1 | 9/2004 | Yong et al. | |
| 2005/0039905 | A1 | 2/2005 | Hart et al. | |
| 2007/0044954 | A1 | 3/2007 | Dewey | |
| 2008/0179107 | A1 * | 7/2008 | Doster | 175/431 |
| 2008/0302575 | A1 | 12/2008 | Durairajan et al. | |
| 2009/0133877 | A1 | 5/2009 | Neff | |
| 2010/0018777 | A1 * | 1/2010 | Pessier et al. | 175/350 |
| 2010/0032155 | A1 * | 2/2010 | Darnell et al. | 166/188 |
| 2011/0155468 | A1 | 6/2011 | Gregurek et al. | |
| 2012/0255785 | A1 | 10/2012 | Gregurek et al. | |
| 2012/0261193 | A1 | 10/2012 | Swadi et al. | |

OTHER PUBLICATIONS

International Search Report and Written Opinion of PCT Application No. PCT/US2012/032389 dated Oct. 29, 2012: pp. 1-12.

International Search Report and Written Opinion of PCT Application No. PCT/US2012/033700 dated Jan. 14, 2013: pp. 1-12.

Dewey et al., "SPE 138001: High Performance Wellbore Departure and Drilling System for Accessing New Target," SPE International, 2011: pp. 1-9.

USPTO Notice of Allowance in U.S. Appl. No. 13/440,708, mailed Mar. 24, 2014 (5 pages).

International Search Report and Written Opinion issued in International Application No. PCT/US2010/062511, mailed Aug. 31, 2011 (11 pages).

USPTO Office Action in U.S. Appl. No. 12/979,842, mailed Sep. 20, 2013 (11 pages).

USPTO Office Action in U.S. Appl. No. 12/979,842, mailed Apr. 8, 2014 (13 pages).

USPTO Advisory Action in U.S. Appl. No. 12/979,842, mailed Jun. 30, 2014 (3 pages).

* cited by examiner

HIGH PERFORMANCE WELLBORE DEPARTURE AND DRILLING SYSTEM

CROSS-REFERENCE TO RELATED APPLICATION

The present document is based on and claims priority to U.S. Provisional Patent Application Ser. No. 61/448,085, filed on Mar. 1, 2011, which is incorporated herein by reference.

BACKGROUND

Directional drilling has proven useful in facilitating production of fluid, e.g. hydrocarbon-based fluid, from a variety of reservoirs. In many applications, a vertical wellbore is drilled, and casing is deployed in the vertical wellbore. One or more windows are then milled through the casing to enable drilling of lateral wellbores. Each window formed through the casing is large enough to allow passage of components, e.g. passage of a bottom hole assembly used for drilling the lateral wellbore and of a liner for lining the lateral wellbore. The bottom hole assembly may comprise a variety of drilling systems, such as point-the-bit and push-the-bit rotary drilling systems.

However, conventional wellbore departure and drilling systems are designed in a manner which generally requires multiple downhole trips. For example, a window milling bottom hole assembly may initially be run downhole to create an exit path in the existing casing of the vertical wellbore. The window milling bottom hole assembly also may be employed to drill a rathole of sufficient size for the next drilling assembly. In a subsequent trip down hole, a directional drilling bottom hole assembly is run to extend the rathole and to drill laterally to a desired target and to thus create the lateral wellbore.

SUMMARY

A system and method are disclosed which facilitate the drilling of lateral wellbores by optionally eliminating one or more trips downhole. The system comprises a steerable drilling assembly and a whipstock. The steerable drilling assembly includes a cutting implement having cutters arranged and designed to enable both milling through a casing and at least partially drilling a lateral wellbore during a single downhole trip. The whipstock is releasably coupled to the cutting implement by an attachment member. The attachment member is arranged and designed to couple the cutting implement to the whipstock during deployment of the whipstock to a desired downhole location and to facilitate release of the cutting implement from the whipstock at the desired downhole location. The attachment member is further arranged and designed to minimize any portion of the attachment member remaining coupled to the whipstock after release of the cutting implement from the whipstock. In one or more embodiments, at least one back-up component is positioned behind at least one of the cutters to control the depth of cutting. The method employs one or more components of the system disclosed herein to provide an economical solution for drilling lateral wellbores by enabling the milling of a casing window and the drilling of a desired lateral wellbore during a single trip downhole. The disclosed system and method also promote good downhole dynamics control and improve overall bottom hole assembly functionality during drilling.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of the present disclosure. However, it will be understood by those of ordinary skill in the art that the present disclosure may be practiced without these details and that numerous variations or modifications from the described embodiments may be possible.

The disclosed invention generally relates to a system and methodology which facilitate the drilling of lateral wellbores by eliminating one or more trips downhole. The system design facilitates formation, e.g. by milling, of a casing window and drilling of a desired lateral wellbore with a single trip downhole. In one or more embodiments, an attachment is provided which improves the temporary connection between the drill bit/mill and the whipstock during conveyance of the whipstock and the drilling assembly downhole through the vertical wellbore to enable creation of the casing window and lateral wellbore. In at least some applications, the cutting implement, e.g. drill bit or mill, is provided with back-up components which are located behind cutters, e.g. polycrystalline diamond compact (PDC) cutters, mounted on the cutting implement.

The control of downhole dynamics and the performance of the bottom hole assembly can be improved by making adjustments to the physical form of the cutting implement according to the parameters of a given application. Simulation software may be employed to facilitate design of the drill bit/mill in a manner which, for example, mitigates vibration for the given application. This optimization of the physical form may involve providing asymmetric location of blades, adjusting cutter layout, and performing other adjustments to the physical form of the cutting implement for the specific application, as explained in greater detail below.

Figure 1:
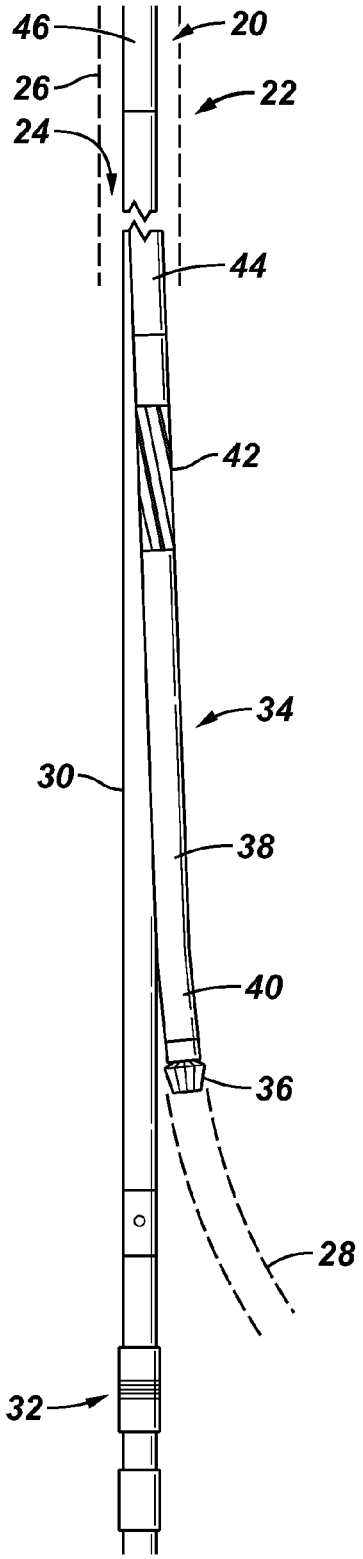
FIG. 1 is an illustration of a whipstock and drilling system deployed in a well to facilitate drilling of a lateral wellbore, according to an embodiment of the present disclosure.

Referring generally to FIG. 1, an embodiment of a drilling system 20 is illustrated as employed in a well 22. The well 22 comprises a vertical wellbore 24 lined with a casing 26, and the drilling system 20 is constructed to facilitate drilling of a lateral wellbore 28. In this embodiment, drilling system 20 comprises a whipstock 30 deployed/positioned in the vertical wellbore 24 and secured by, for example, a hydraulic anchor 32. The drilling system 20 also comprises a drilling assembly 34 designed to facilitate drilling of the lateral wellbore 28 using a steerable assembly/system to achieve the desired objectives (i.e., target depth, angle, etc) from the wellbore.

Drilling assembly 34 may comprise a bottom hole assembly having a variety of components depending on the specifics of a drilling application. The example illustrated is just one embodiment which may be employed to drill the desired lateral wellbore 28. In this embodiment, the drilling assembly 34 is used to rotate a cutting implement 36, such as a drill bit/mill. The cutting implement 36 is uniquely designed to enable both the cutting/milling of a window through casing 26 and the drilling of a lateral wellbore 28 through the adjacent formation for an extended, desired length, e.g. target, all, optionally, during a single trip downhole into the well.

Examples of other components that may be utilized in drilling assembly 34 include a motor 38, e.g. a mud motor, designed to rotate cutting implement 36. A turbine (not shown) may also be equally employed to rotate cutting implement 36. The drilling assembly 34 with directional control (or a steerable drilling assembly) may comprise a bent angle housing 40 to direct the angle of drilling (i.e., directionally control the drilling) during drilling of lateral wellbore 28. The drilling assembly 34 with directional control for directionally controlling the wellbore may alternatively employ other directional control systems including, but not limited to, push-the-bit or point-the-bit rotary steerable systems (not shown). A variety of other features and components may be incorporated into drilling assembly 34, such as a watermelon mill 42, a running tool 44, and a measurement while drilling tool 46. The specific components and the arrangement of such components are selected according to the specific drilling application and environment.

Figure 2:
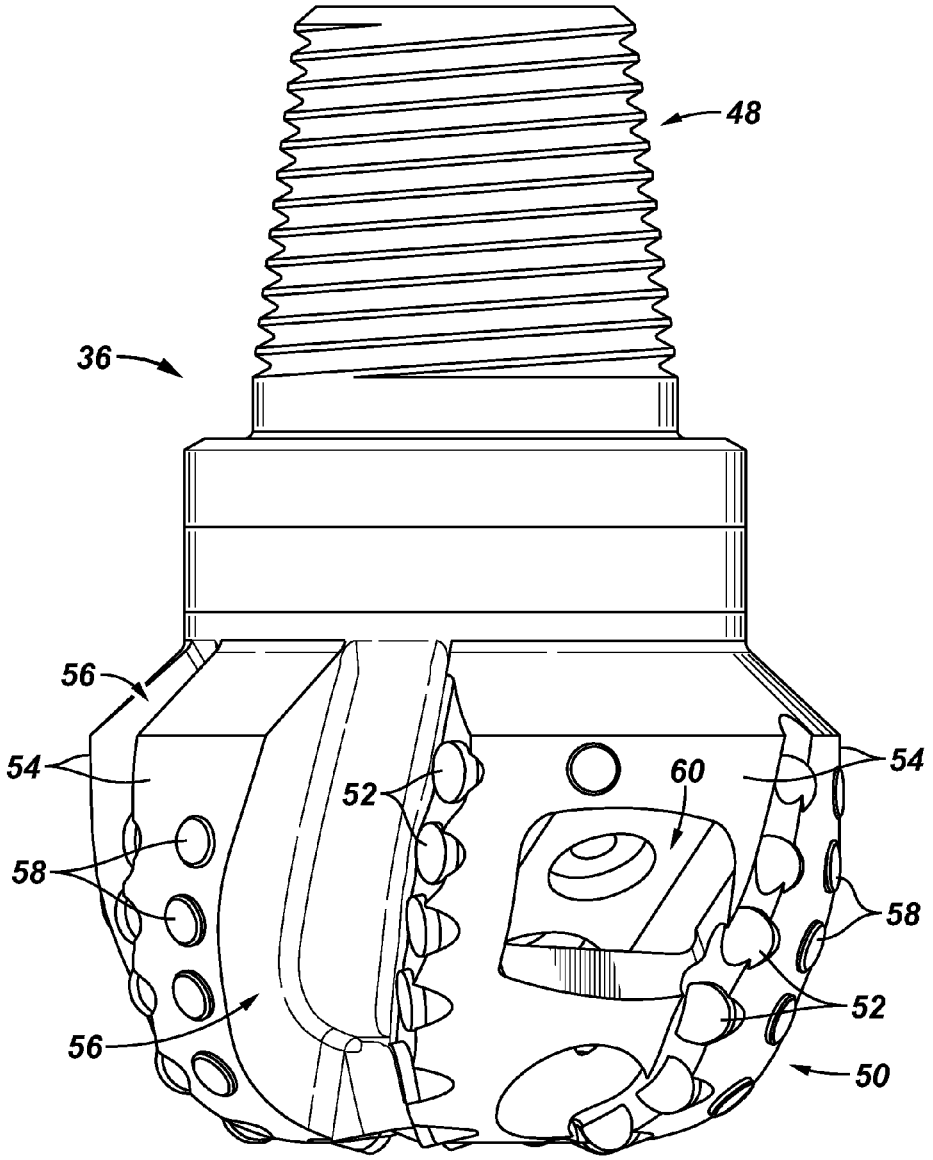
FIG. 2 is a side view of a cutting implement design to mill a casing window and to drill the lateral wellbore during a single trip downhole, according to an embodiment of the present disclosure.

One example of cutting implement 36 is illustrated in FIG. 2. In this embodiment, cutting implement 36 comprises an attachment end 48 and a cutting end 50. The cutting end 50 comprises a plurality of cutters 52, such as polycrystalline diamond compacts (PDC) cutters designed and positioned to mill through casing 26 (FIG. 1) and to drill the lateral wellbore 28 (FIG. 1) over a substantial distance to target. In the example illustrated, cutters 52 are mounted on blades 54 separated by junk channels 56. Additionally, the cutting end 50 comprises a plurality of back-up components 58 which are positioned to control, e.g. limit, the depth of cutting by cutters 52. By way of example, the back-up components 58 may be in the form of inserts, which are inserted into blades 54 behind corresponding cutters 52.

Figure 3:
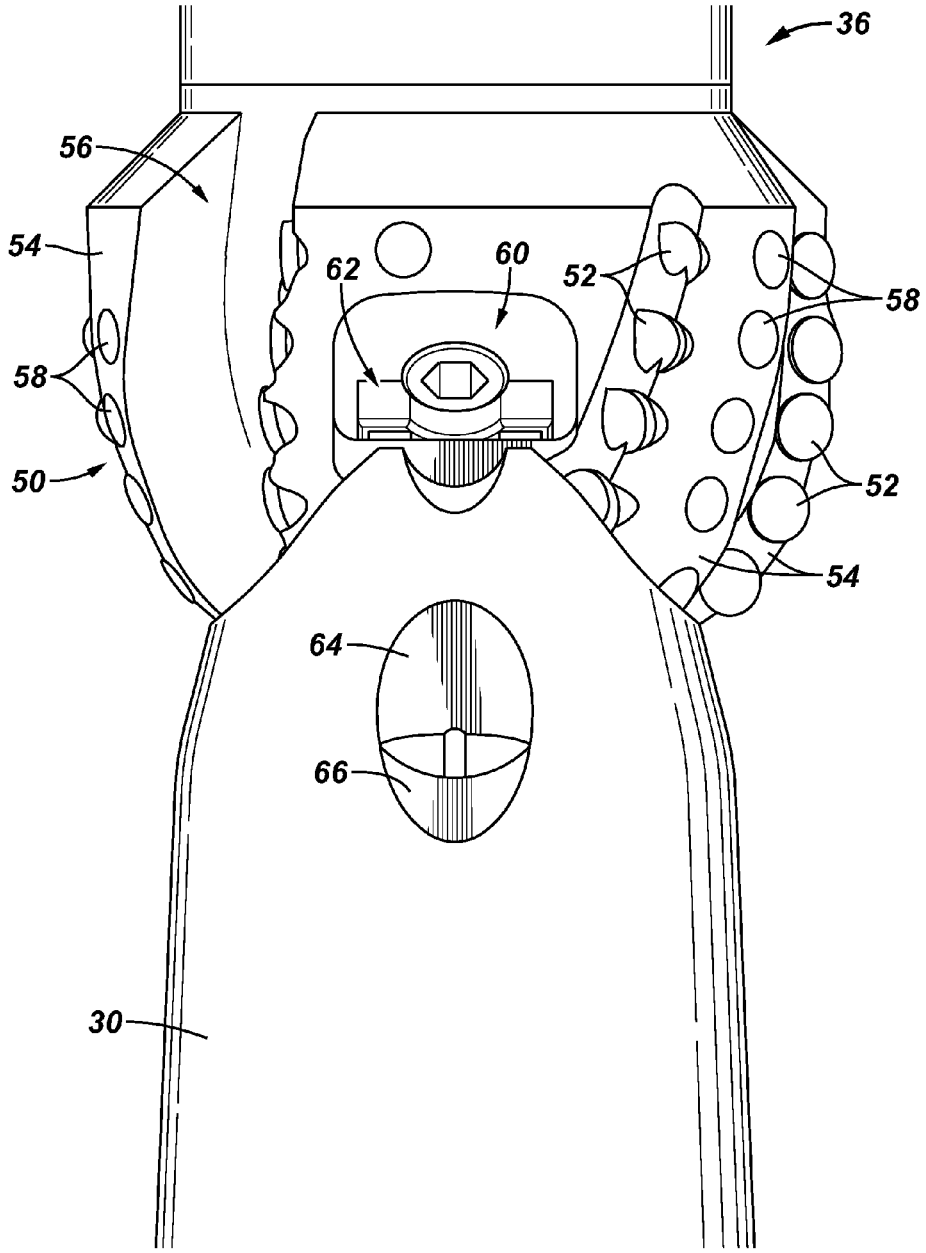
FIG. 3 is a perspective view of a whipstock connected to the cutting implement by an attachment system for conveyance downhole, according to an embodiment of the present disclosure.
Figure 4:
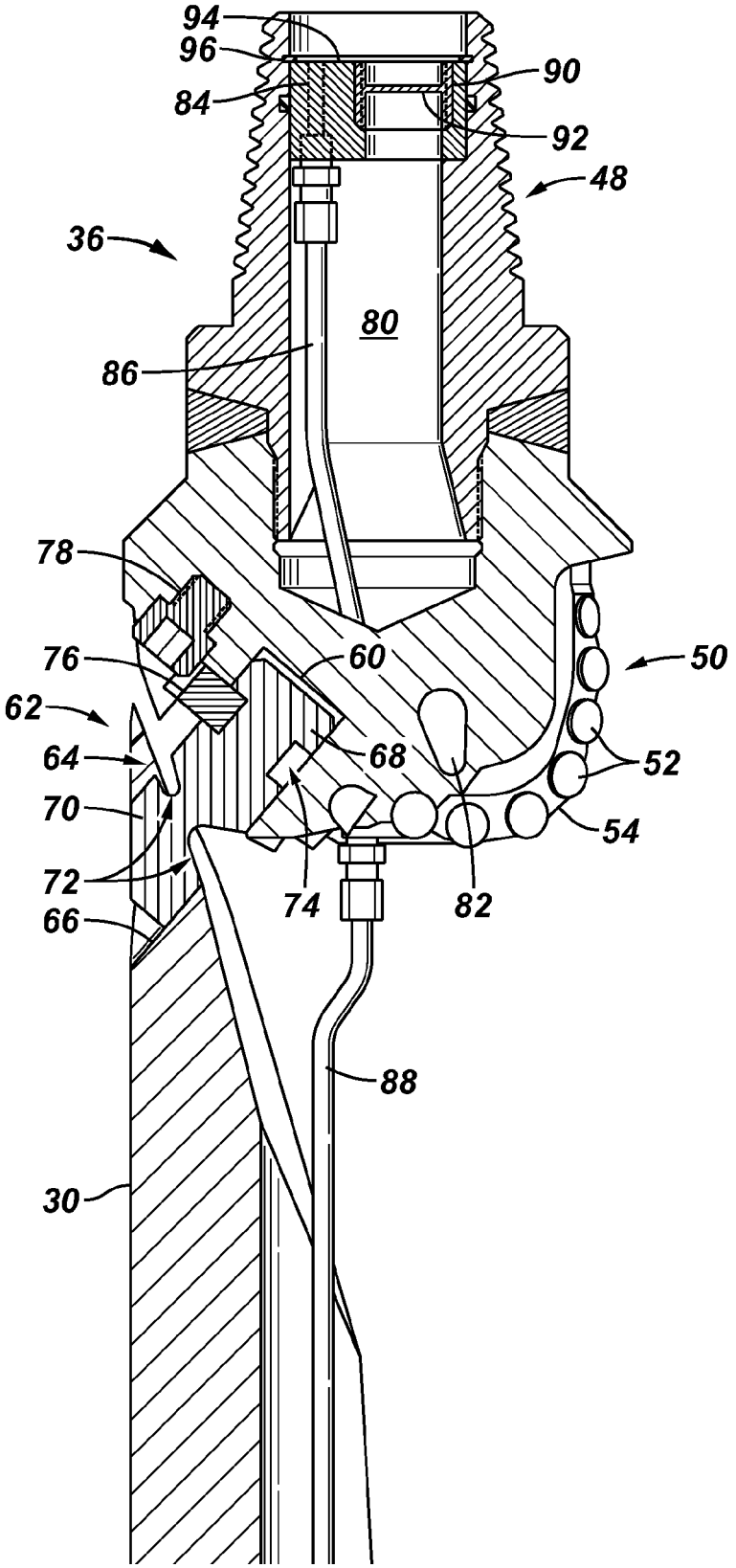
FIG. 4 is a cross-sectional illustration of the whipstock coupled to the cutting implement, according to an embodiment of the present disclosure.

The cutting implement 36 also may comprise a recess or recessed region 60 for receiving a whipstock attachment system 62, as further illustrated in FIGS. 3 and 4. The whipstock attachment system 62 comprises an attachment member 64, e.g. a notched pin or bolt, extending between recessed region 60 in cutting implement 36 and a recess or opening 66 in whipstock 30. The attachment member 64 is arranged and designed to releasably couple the cutting implement 36 to the whipstock 30. In the example illustrated, the attachment member 64 comprises an attachment base 68 received in recessed region 60 and an attachment head 70 received in opening 66 of whipstock 30. The attachment member 64 also may comprise one or more notches 72 located at a base of head 70, generally between the whipstock 30 and the surface of cutting end 50, as illustrated in FIG. 4. As will be disclosed in greater detail hereinafter, the attachment member 64 is arranged and designed to be broken or severed at the one or more notches 72 thereby releasing the coupling of attachment member 64 between cutting implement 36 and whipstock 30. Along attachment base 68, a groove 74 is formed to receive an attachment member retainer 76, such as a retainer plate. Retainer 76 secures the attachment member 64 within recessed region 60 of cutting implement 36. Retainer 76, in turn, is secured in engagement with attachment member 64 by a locking member 78, such as a bolt/locking screw threadably received in the bit body of cutting implement 36.

The actual size and configuration of attachment system 62 may vary according to the specifics of a drilling operation and/or environment. In one embodiment, however, the attachment member 64 is secured to an upper portion of the whipstock 30 by welding. The attachment head 70 of the attachment member 64 is received within opening 66 such that the attachment member 64 protrudes at an angle a few inches above the upper end of the whipstock 30. The attachment member 64 is subsequently welded in place. In this embodiment, the attachment member 64 is secured to cutting implement 36 between a pair of blades 54, but below the cutters 52 on gauge. This ensures that after the cutting implement 36 is coupled to the whipstock 30, the entire assembly gauges properly.

When the whipstock 30 is anchored/secured to the wellbore by hydraulic anchor 32, the attachment member 64 is designed to break at one or more notches 72 if the cutting implement 36 is subsequently pulled up with sufficient force. The one or more notches 72 may be positioned and designed to shear the attachment member 64 generally flush or nearly flush with the whipstock 30 so as to leave minimal, if any, protrusion of the remaining portion of attachment member 64 from opening 66 (i.e., protruding off the face of the whipstock 30) after shearing. Thus, the one or more notches 72 are designed to sever the attachment member 64 not at a right angle but at an angle that is similar to (or approaches) the slope angle/profile of the whipstock 30. Likewise, the shearing of the attachment member 64 is arranged and designed to leave the remainder of the attachment member 64 coupled to the cutting implement 36 generally at or below the profile of the cutting structure. The remainder of the attachment member 64 coupled to the cutting implement is securely retained in recessed region 60 of cutting implement 36 so that once milling of the casing 26 is initiated, a very minimal portion (if any) of the attachment member 64 remaining coupled to cutting implement 36 is milled away before cutting the window through casing 26. The remaining portion of attachment member 64 protruding from opening 66 is less than that portion of attachment member 64 that remains within opening 66 of whipstock 30 or that remains within the cutting profile of cutting implement 36. As a result of this arrangement, the torque required to mill any portion of the attachment member 64 is lower and the damage to cutters 52 is minimized. Additionally, the design improves the ability to maintain the correct tool face for milling the window through the casing and for departing more easily into the surrounding formation.

In the example illustrated, the cutting implement 36 comprises a generally hollow interior having a primary flow passage 80 for conducting fluid, e.g. drilling fluid, to outlet nozzles 82. Additionally, a bypass port 84 is connected to a secondary flow passage 86, which directs a secondary flow of fluid to a tubing 88 coupled between a face of the cutting implement 36 and the whipstock 30. The tubing 88 is employed to convey hydraulic fluid and pressure to hydraulic anchor 32 (FIG. 1) to enable actuation of the hydraulic anchor 32 (FIG. 1). In one example, the tubing 88 is engaged with a port (not shown) formed in the whipstock 30 to deliver a pressurized fluid along a passage (not shown) through the whipstock 30 to the hydraulic anchor 32.

Referring again to FIG. 4, a rupture disk assembly 90 having a rupture disk 92 is positioned at an entrance of primary flow passage 80. The rupture disk 92 prevents fluid from flowing through primary flow passage 80 within the cutting implement 36 to the annulus, thereby also isolating the pressure in flow passage above the rupture disk 92 from the annulus. By way of example, the rupture disk 92 may be threaded into a manifold 94 which is held in place by retainer 96, such as a snap ring. Bypass port 84 may extend through the manifold 94 for enabling pressure to be communicated to tubing 88 and through the whipstock 30. By way of example, the tubing 88 may comprise a hydraulic hose connected into one of the outlet nozzles 82. The other nozzle ports 82 may be left open and do not require break-off plugs (not shown) because of the use of rupture disk assembly 90. As a result, the cutters are exposed to a reduced amount of shrapnel from the lack of break-off plugs. The rupture disk assembly 90 is one example of a device for controlling flow, and other types of flow control devices could be used, e.g. other types of frangible members, valves, or other flow control devices suitable for a given application.

Combination of the whipstock attachment system 62 and the hydraulic flow control within cutting implement 36 reduces potential damage to the cutting end 50 of cutting implement 36 by reducing or eliminating milling of a connector, and thereby, reducing debris. These improvements also reduce the amount of detrimental vibrations experienced by cutting implement 36, thus facilitating both milling of the casing window and drilling of extended laterals 28 into one or more proximate formations during a single trip downhole.

Additionally, the overall structure and arrangement of specific components of cutting implement 36 can be used to improve the milling and drilling capabilities of the cutting implement according to the specifics of a given application. Adjustments to the cutting structure may include adjustments to back-up/insert profile, insert layout, body profile, and body details. The geometry, material properties and cutting structure of any additional mills and reamers in the bottom hole assembly, e.g. drilling assembly 34, as well as the geometry, configurations, material properties and actions of other drilling assembly components, e.g., whipstock, etc., can affect the milling and drilling capabilities. Further, the casing geometry and material of construction can also affect the milling and/or drilling capabilities. In operation, the cutting implement 36 is able to mill through, for example, the metal material of casing 26 and then continue to drill through rock of the subterranean Earth region in which a lateral borehole 28 is formed/drilled.

In one or more applications, the various characteristics of the cutting implement 36 as well as other drilling system components can be determined and/or optimized with the aid of analytical software, such as the IDEAS analysis program of Schlumberger Corporation. The analytical software is useful in processing the parameters and variables defining component and application characteristics to better select optimal configurations of the cutting structure and body shape of cutting implement 36. The analytical software also may be used to determine other optimized geometries and materials in the cutting implement 36 and in other drilling assembly components. The configuration optimization may be based on optimizing the performance of the cutting implement 36 for reliably cutting specified windows in the casing 26 with the intent of reliably continuing afterwards to drill at improved performance into the surrounding formation to an expected or desired target depth.

FIGS. 5-12 illustrate a variety of configurations of cutters 52 and back-up components/inserts 58 to facilitate milling and drilling. Again, analytical software, such as the IDEAS analysis program, may be utilized to better optimize the cutter and insert configurations and/or arrangements to provide reasonably stable, low-vibration drilling on specific drilling assemblies used first for casing window milling and then for lateral wellbore 28 drilling. Aspects considered during adjustment and selection of the cutting structures include, for example, cutter spacing and overlap along the profile as well as the arrangement of cutters 52 along blades 54. Other aspects include selection of spirals, leads, plurality, rakes, reliefs, sizes and shapes as well as the specific angular position and variance in sweep of the cutters 52. Consideration also may be given to the positions, shapes and materials of any portions of the body of the cutting implement 36 and of the inserts 58 that may (by design or incidence) contact the casing 26, the whipstock 30, surrounding cement, or the formation. Additional aspects that may be considered include the relative quantity of materials removed by each cutter 52 and the calculated performance of the cutting structure and other components in successfully milling the casing window at reasonable speed with minimal expected vibration.

In one or more applications, the cutting implement design and selection process suggests relatively heavy-set, slightly asymmetrical cutter layouts with minimal exposure above the body surfaces of blades 54. Further, the back-up components/inserts 58 are positioned to inhibit excess gouging and to trail the cutters on or closely preceding the cutting implement gauge area.

Figure 5:
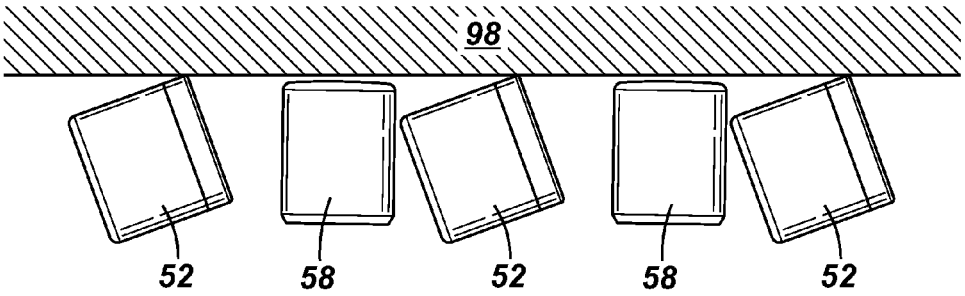
FIG. 5 is a schematic rollout view of cutters and back-up members/inserts during a cutting sequence, according to an embodiment of the present disclosure.
Figure 6:
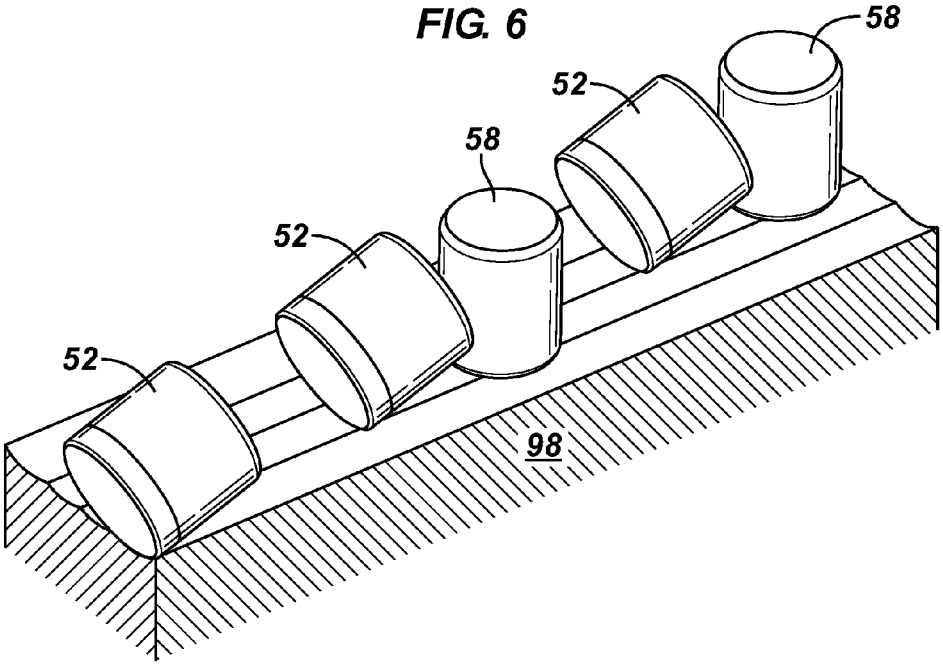
FIG. 6 is another schematic rollout view of cutters and back-up members during a cutting sequence, according to an embodiment of the present disclosure.
Figure 7:
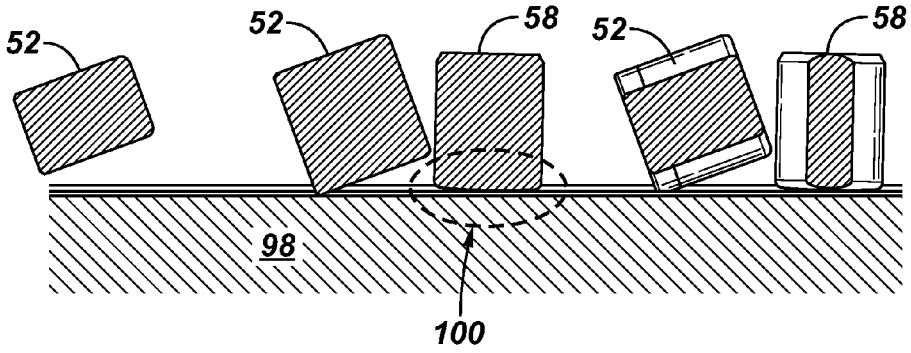
FIG. 7 is another schematic rollout view of cutters and back-up members during a cutting sequence, according to an embodiment of the present disclosure.

Referring generally to FIG. 5, a rollout view of the cutters 52 and back-up components/inserts 58 is illustrated. The figure shows relative positions and exposure heights of the cutters and inserts when addressing a section of material 98, e.g., casing and/or formation, to be cut, e.g. milled. In one or more embodiments, the gap between the cutter and the back-up component is preferably in the range of about −0.050 inches to about 0.100 inches. The negative dimensions indicate those instances in which the back-up component is engaging material 98 by such dimensions. More preferably, the gap between the cutter and the back-up component is in the range of 0.000 inches to 0.100 inches. Most preferably, the gap between the cutter and the back-up component is in the range of 0.030 inches to 0.100 inches. In FIGS. 6 and 7, the cutters 52 are illustrated as cutting into the section of material 98 while the inserts 58 limit the cutting depth through contact with the section of material 98 at a contact region 100. Thus, the back-up component is arranged and designed to contact the cut surface generated by the cutter it trails during the milling/drilling operation. In this arrangement, the inserts 58 are used to protect the cutters and/or to reduce vibration.

Figure 8:
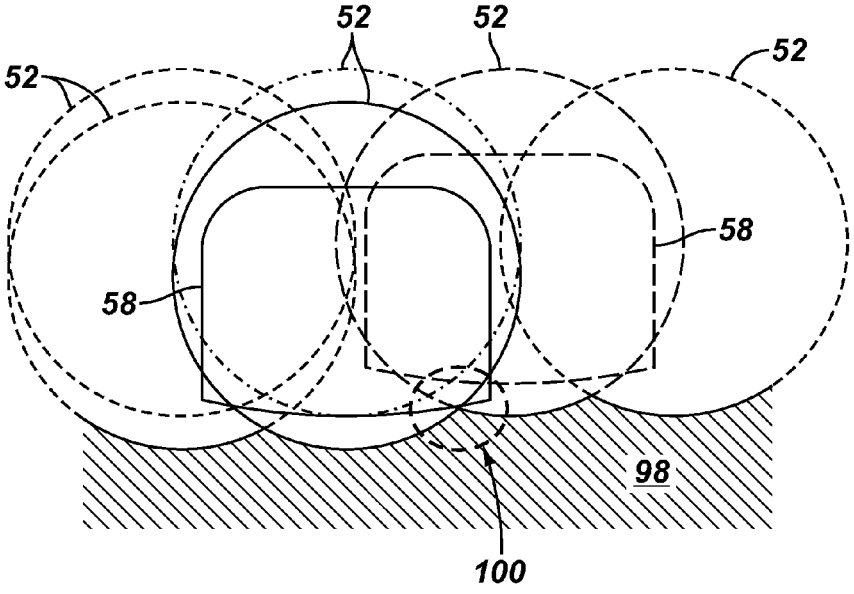
FIG. 8 is a profile-section view of cutters and back-up members during a cutting sequence, according to an embodiment of the present disclosure.
Figure 9:
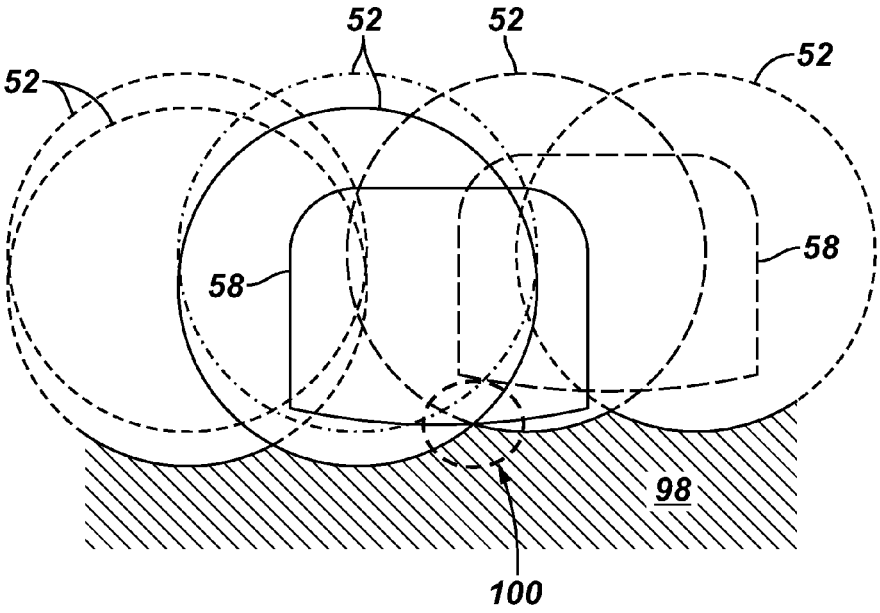
FIG. 9 is another profile-section view of cutters and back-up members during a cutting sequence, according to an embodiment of the present disclosure.
Figure 10:
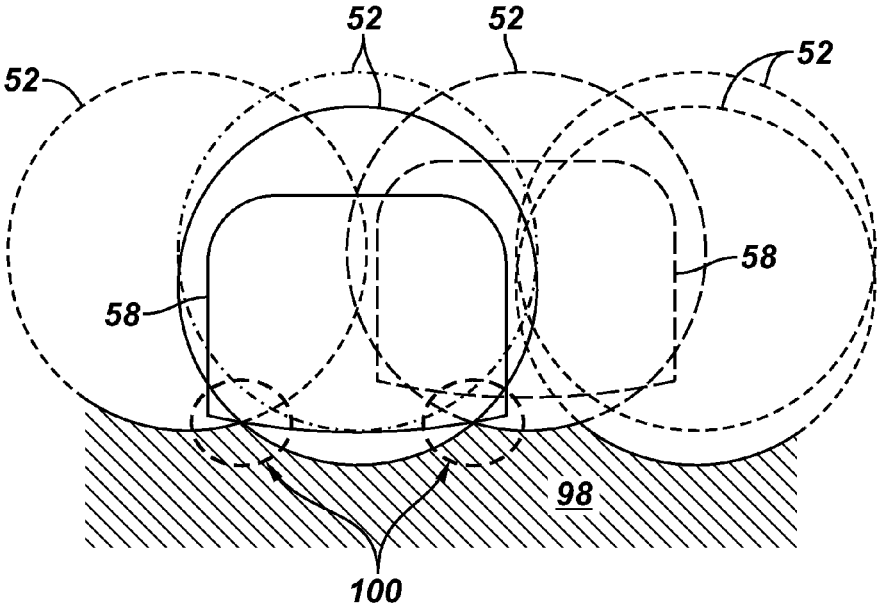
FIG. 10 is another profile-section view of cutters and back-up members during a cutting sequence, according to an embodiment of the present disclosure.
Figure 11:
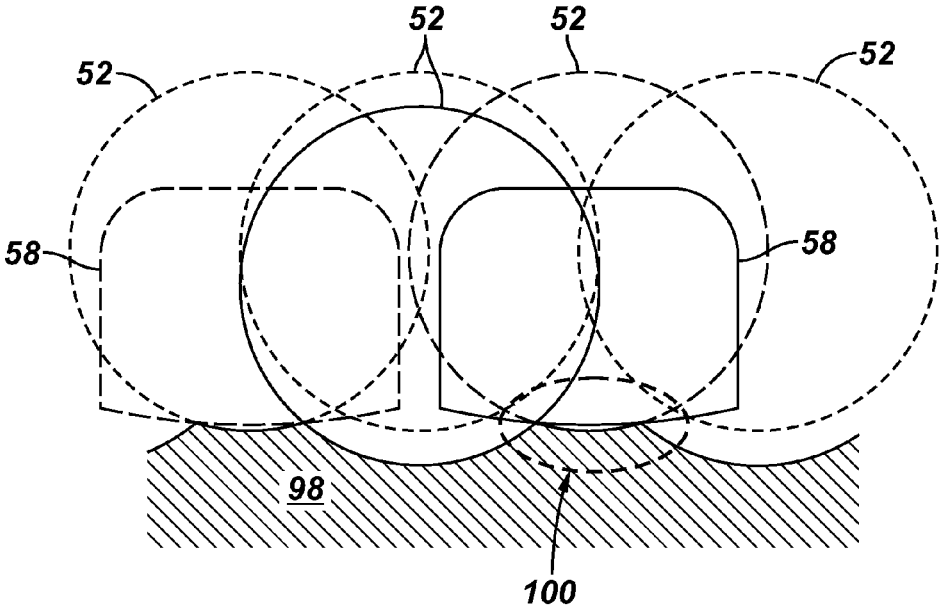
FIG. 11 is another profile-section view of cutters and back-up members during a cutting sequence, according to an embodiment of the present disclosure.
Figure 12:
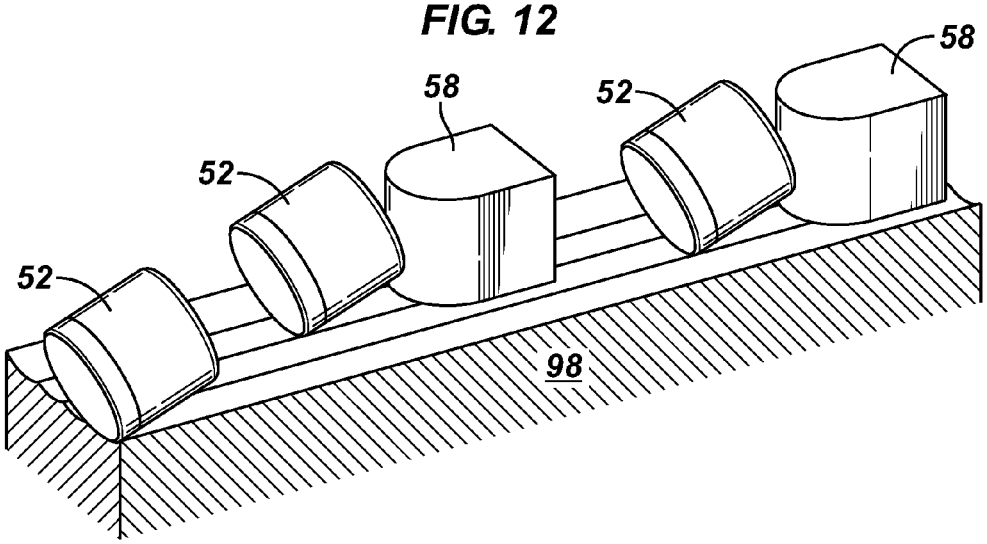
FIG. 12 is a schematic rollout view of another embodiment of cutters and back-up members during a cutting sequence, according to an embodiment of the present disclosure.

In FIG. 8, another arrangement of cutters 52 and inserts 58 is illustrated in a profile-section view. The cutters 52 are positioned to cut into the section of material 98 at different levels, while the inserts 58 utilize a different shape and placement designed for the specific application and material being cut. Similarly, FIG. 9 provides another profile-section view of an alternate arrangement of cutters 52 and inserts 58. In this example, the inserts 58 are designed and positioned to limit cutting depth by contacting the section of material 98 at a different contact region 100. By way of further example, the size, shape and arrangement of cutters 52 and inserts 58 may be selected such that inserts 58 control the cutting via contact with the section material 98 at multiple contact regions 100, as illustrated in the alternate embodiments of FIG. 10 and FIG. 11. As further illustrated in the alternative example of FIG. 12, the size and shape of both the cutting elements 52 and back-up components/inserts 58 can be adjusted to optimize cutting performance. For example, in one or more embodiments, the contact surface on the back-up component has a radius of curvature greater than half the cutter diameter. As shown in FIG. 12, the inserts have been lengthened and provided with a semicircular lead end and flat trailing end. However, the size, figuration, arrangement, material selection, and other features of the cutters, inserts, cutting implement design, and overall system component design may be adjusted in a variety of additional ways to optimize or otherwise enhance performance of the overall drilling system.

By way of further example, an analytical, dynamic modeling software, such as the IDEAS analysis program, may be employed to balance the cutting structure by considering contact surfaces, forces, and abrasion on mills, reamers, and other drilling assembly components. The cutters 52 may be PDC cutters and the layout of cutters 52 may be arranged to include spiral, plural, and staggered layouts. Additionally, the sizes, trailing exposure, and other cutter parameters can be adjusted to optimize the milling/drilling application. Similarly, the arrangement, shape, materials selected, and the surface/edge/layer details of the inserts 58 can be optimized according to the specifics of the drilling application and environment. The materials selected may include superhard materials, e.g. diamond or CBN materials, ceramic materials, sintered/infiltrated composites, impregnated materials, controlled density materials, and other materials selected for use as cutting edges, abrasive elements, bearing surfaces, and/or sacrificial wear inserts/pads. Also, the cutters 52 and the inserts 58 may be formed from different materials.

The relative exposure of the inserts 58 in comparison to PDC tips of cutters 52 also can be important. A range of PDC tip exposures above the blades 54 also may be implemented along with various coatings on the outer surfaces of the blades. Additionally, the interaction of the inserts 58 and the milled surfaces left by, for example, PDC cutters 52, can be optimized to inhibit gouging, whirl, and vibration of the cutting implement 36 and overall drilling assembly. The analytical software, such as the IDEAS software, helps enable optimization of these various relationships to improve the life of the drilling system components. The analysis also helps provide cutter implement designs which facilitate milling of the casing window and drilling of the lateral wellbore over a substantial length to a target destination in a single trip downhole.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for facilitating drilling of a lateral wellbore, comprising:

a drilling assembly with a steerable drilling assembly, the drilling assembly including a cutting implement having cutters arranged and designed to enable both milling through a casing and at least partially drilling a lateral wellbore during a single downhole trip;

a whipstock having a face with a profile arranged and designed to guide the cutting implement during milling of the casing, the whipstock also having an anchoring device coupled thereto to secure the whipstock at a desired downhole position in a wellbore; and an attachment member releasably coupling the cutting implement to the whipstock, the attachment member coupling to the cutting implement through a recess disposed in the cutting implement and coupling to the whipstock through an opening disposed in the whipstock, the attachment member being held within the recess of the cutting implement by a removable retainer, the attachment member further being arranged and designed to:

releasably couple the whipstock to the cutting implement such that the whipstock remains below a gauge area of the cutting implement, and radially within a gauge of the cutting implement; and be severed such that any severed portion of the attachment member remaining coupled to the whipstock is nearly flush with the face of the whipstock.

2. The system as recited in claim 1, wherein the cutters include polycrystalline diamond compact (PDC) cutters.

3. The system as recited in claim 2, wherein the cutting implement has at least one back-up component positioned behind at least one of the PDC cutters.

4. The system as recited in claim 3, wherein the at least one back-up component is arranged and designed to limit cutting depth of the at least one of the PDC cutters.

5. The system as recited in claim 3, wherein the at least one back-up component is constructed of a different material than the at least one of the PDC cutters.

6. The system as recited in claim 3, wherein the cutting implement has an arrangement of cutters on each of a plurality of blades, the arrangement being selected such that relative exposure of the PDC cutters above the plurality of blades of the cutting implement optimizes a cutting parameter.

7. The system as recited in claim 1, wherein the cutting implement has an arrangement of cutters on each of a plurality of blades, the arrangement being selected to mitigate vibration for a given drilling application.

8. The system as recited in claim 1, wherein the attachment member has at least one notch in an external surface thereof, the at least one notch being arranged and designed to facilitate severing of the attachment member to release the cutting implement from the whipstock.

9. The system as recited in claim 8, wherein the at least one notch is angled.

10. The system as recited in claim 1, wherein the removable retainer is held in place by a locking member coupled to the cutting implement.

11. A method of facilitating the drilling of a lateral wellbore, comprising:

deploying a steerable drilling assembly and a whipstock downhole to a desired location in a wellbore at which a lateral wellbore is to be drilled, the drilling assembly having a cutting implement with cutters arranged and designed to enable both milling through casing and at least partially drilling the lateral wellbore, the cutting implement being releasably coupled to the whipstock via an attachment member, the attachment member being coupled to the cutting implement by a removable retainer and between a recess disposed in the cutting implement and an opening disposed in a sloped face of the whipstock, the sloped face arranged and designed to guide the cutting implement during milling of the casing, the whipstock also having an anchoring device coupled thereto to secure the whipstock at the desired downhole location in the wellbore;

anchoring the whipstock at the desired downhole location in the wellbore through activation of the anchoring device;

releasing the cutting implement from the whipstock by applying force to the cutting implement thereby shearing the attachment member such that any severed portion of the attachment member remaining coupled to the whipstock and protruding from the opening in the whipstock is minimized; and milling through the casing and at least partially drilling the lateral wellbore, the milling and drilling steps being conducted in a single trip downhole.

12. The method as recited in claim 11, the removable retainer coupling the attachment member to the cutting implement by engaging a groove on an external surface of the removable attachment member.

13. The method as recited in claim 11, wherein the cutters include PDC cutters mounted on each of a plurality of blades.

14. The method as recited in claim 13, wherein the cutting implement also includes at least one back-up component mounted behind at least one of the PDC cutters.

15. The method as recited in claim 11, wherein shearing the attachment member includes shearing the attachment member at an angle about equal to a slope of the sloped face of the whipstock.

16. A system for facilitating drilling of a lateral wellbore, comprising:

a drilling assembly with directional control, the drilling assembly including a cutting implement having blades with cutters coupled thereto, the cutters arranged and designed to enable both milling through a casing and at least partially drilling a directional wellbore during a single trip downhole;

at least one back-up component positioned behind at least one of the cutters, and on a same blade as the at least one of the cutters, the at least one back-up component arranged and designed to control a depth of cutting by the at least one of the cutters; and a whipstock releas ably coupled to the cutting implement by an attachment member, the attachment member arranged and designed to couple the cutting implement to the whipstock during deployment of the whipstock to a desired downhole position and to facilitate release of the cutting implement from the whipstock at desired downhole position, the attachment member being at least partially secured to the cutting implement using a removable retainer separate from the attachment member and which is removable from the cutting implement, the attachment member being further arranged and designed to minimize any portion thereof remaining coupled to the whipstock after release of the cutting implement from the whipstock.

17. The system as recited in claim 16, wherein the at least one back-up component is constructed of a different material than the at least one of the cutters.

18. The system as recited in claim 16, wherein the attachment member has at least one notch in an exterior surface thereof, the at least one notch being arranged and designed to facilitate severing of the attachment member to release the cutting implement from the whipstock.

19. The system as recited in claim 18, wherein the at least one notch is arranged and designed to facilitate severing of the attachment member at a non-right angle.

20. The system as recited in claim 18, wherein the attachment member has at least one groove in an exterior surface thereof, the at least one groove being arranged and designed to receive at least a portion of the removable retainer.

* * * * *